United States Patent [19]

Osaki

[11] Patent Number: 4,479,290

[45] Date of Patent: Oct. 30, 1984

[54] SPACE FORMING AND STOP FIXING APPARATUS FOR FASTENER CHAINS

[75] Inventor: Tatsuo Osaki, Toyama, Japan

[73] Assignee: Yoshida Kogyo K. K., Tokyo, Japan

[21] Appl. No.: 376,143

[22] Filed: May 7, 1982

[30] Foreign Application Priority Data

May 20, 1981 [JP] Japan ..... 56-76183

[51] Int. Cl.[3] ..... B29D 5/00

[52] U.S. Cl. ..... 29/33.2; 29/34 A; 29/767

[58] Field of Search ..... 29/33.2, 34 A, 767, 29/770, 35 M, 766

[56] References Cited

U.S. PATENT DOCUMENTS

| | | | |
|---|---|---|---|
| 2,385,836 | 10/1945 | Norkin et al. | 29/33.2 |
| 2,701,877 | 2/1955 | Morin | 29/767 |
| 2,702,064 | 2/1955 | Lange | 29/767 |
| 2,972,150 | 2/1961 | Wegrzyn | 29/33.2 |
| 2,987,809 | 6/1961 | Burbank | 29/770 |
| 3,445,912 | 5/1969 | Perlman | 29/767 |
| 3,611,534 | 10/1971 | Takamatsu | 29/767 |
| 3,872,571 | 3/1975 | Douri | 29/33.2 |
| 4,083,269 | 4/1978 | Resch | 81/9.51 |

*Primary Examiner*—Z. R. Bilinsky
*Assistant Examiner*—Thomas M. Kline
*Attorney, Agent, or Firm*—Hill, Van Santen, Steadman & Simpson

[57] ABSTRACT

In the apparatus for forming a space in and simultaneously fixing a stop to a fastener chain of this invention, a casing is provided with a tubular frame portion in which a punch holder having a space punch and a driver punch is received for sliding movement. This apparatus further includes a cutting punch between the driver punch and the inner wall of the tubular frame portion. When the punch holder descends, the cutting punch cuts a stop forming wire and forms the cut wire length into a stop preform in cooperation with an anvil. As the punch holder further descends, the driver punch drives the stop preform into the tapes of the chain and simultaneously the space punch forms a space in the chain. During this operation, the cutting punch rises relative to the punch holder so as not to damage the tapes.

5 Claims, 10 Drawing Figures

SPACE FORMING AND STOP FIXING APPARATUS FOR FASTENER CHAINS

BACKGROUND OF THE INVENTION

This invention relates to an apparatus for forming a space in a continuous fastener chain consisting of inter-engaged stringers by removing fastener elements and simultaneously fixing a stop to the fastener chain at a place along the fastener element array adjacent the space.

The apparatus disclosed in U.S. Pat. No. 2,972,150 is known to simultaneously achieve space forming and stop fixing. In this apparatus, a space punch for shearing off the head portions of fastener elements to form a space and a driver punch for driving a stop into the tapes of a chain are mounted on a press head so that the space and driver punches move in unison. Therefore, when the press head descends, a space is formed and simultaneously a stop is fixed to the tapes. However, in this apparatus, another device is used for previously forming stop preforms of a bottom-opened rectangular shape. Therefore, the number of operation steps is increased. Furthermore, a feeding device for the stop preforms is complicated because the thus formed individual stop preforms must be guided to the place below the driver punch so that the preforms are positioned there in accurate orientation.

A mechanism is also known which obviates use of such previously formed stop preforms by feeding a wire used as material for stops, cutting the wire to an appropriate length and simultaneously bending the length to make a stop preform by a punch and driving the stop preform by a driver punch into the tapes. However, if this mechanism is provided adjacent a space punch intending to fix a stop in the vicinity of an end of a space simultaneously with formation of the space, the resulting apparatus as a whole becomes complicated because various kinds of punches are concentrated in one place. This makes replacement of the punches very time consuming. Since these punches are desired to be easily replaceable when they get worn and/or damaged or different kinds of tapes are used, an apparatus satisfying such desire has been called for.

SUMMARY OF THE INVENTION

Therefore, an object of this invention is to provide an apparatus in which a wire is used as material for stops and space formation and stop fixing are simultaneously done with easily replaceable punches.

According to the invention, this object is achieved by an apparatus comprising a casing having a tubular frame portion, a punch holder slidably received in the tubular frame portion and having a space punch and a driver punch connected to the punch holder, a cutting punch provided between the driver punch and the inner wall of the tubular frame portion, a bender mounted on the casing for movement between a position in which it projects into the path of the driver punch movement and a retracted position in which it is out of the path of the driver punch movement; and a wire feeder for feeding a stop forming wire onto the top of the bender. In this apparatus, the cutting punch has an edge at the margin of the lower end thereof to cut the wire by a predetermined length and the lower end portion of the cutting punch is bifurcated to form a stop of a bottom-side-opened rectangular shape in cooperation with the bender. The cutting punch further has a channel for slidably guiding the driver punch so that the driver punch moves relative to the cutting punch to press the top of the stop. The cutting punch and the punch holder are connected through a mechanism which makes the cutting punch move down with the punch holder to a preselected point and thereafter permits only downward movement of the punch holder. The structure of this apparatus is compact since the space punch, driver punch and cutting punch are all received in the tubular frame portion of a sole casing. Furthermore, replacement of the punches is easy since drawing the punch holder from the tubular frame portion is enough for removing all the punches out of the frame portion.

BRIEF DESCRIPTION OF THE DRAWINGS

Other objects of this invention will be made clear from the following description of the embodiments referring to the drawings, in which.

DETAILED DESCRIPTION OF THE PREFERRED EMBODIMENT

Figure 1:
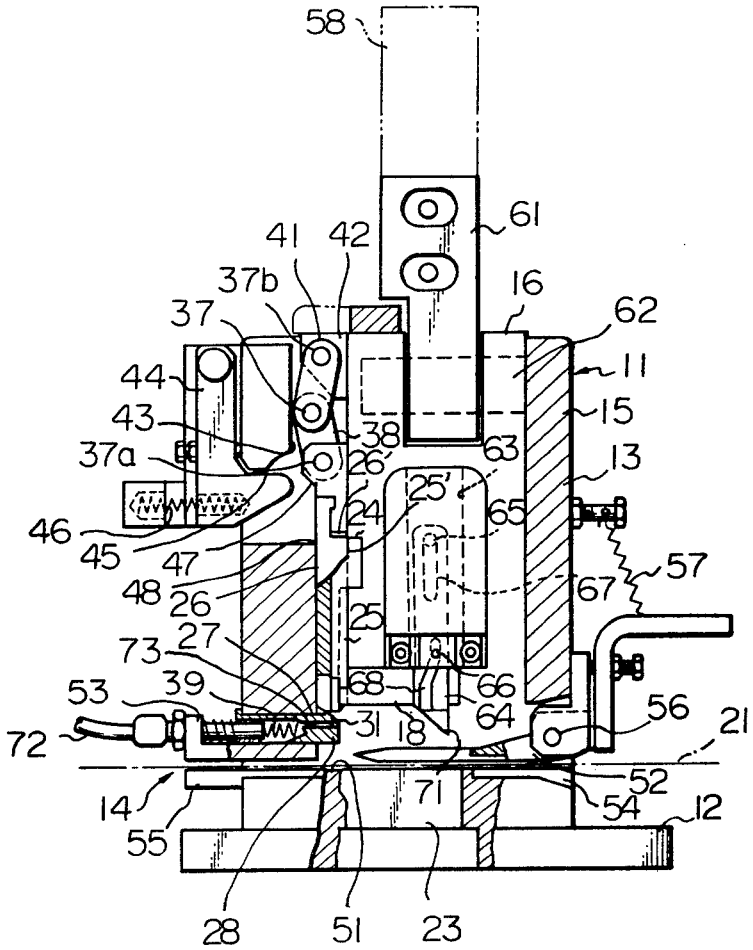
FIG. 1 is a longitudinal sectional view of an apparatus according to one embodiment of this invention.

First, the general construction of this invention will be explained referring to FIGS. 1 and 2. Numeral 11 designates a casing having a base 12 and a casing body 13 standing upright on the base. The casing body 13 is transversely formed with a chain passage 14 in the lower portion thereof. The portion of the casing 11 above the chain passage forms a tubular frame portion 15 in which a punch holder 16 is received for sliding in vertical direction. A space punch 18 is secured to the punch holder 16 by screws (not shown) so that a portion of the space punch projects from the bottom surface of the punch holder. The space punch 18 has a thin configuration and it shears off the head portions of fastener elements 22 at a portion of a continuous fastener chain 21 as shown in FIG. 3 thereby permitting the legs of the elements clamping the beaded edges of the tapes of the chain to come off the beaded edges to form a space of a predetermined length. A die 23 having an opening for receiving the space punch 18 is provided below the chain passage 14.

The punch holder 16 is transversely formed with a groove 24 in which the head portion 25' of a driver punch 25 engages. Thus, the punch 25 vertically moves in unison with the punch holder 16 without fixing the punch to the holder by bolts or the like. A cutting punch 26 is provided between the driver punch 25 and an inner wall of the tubular frame portion 15. The cutting punch is formed with a channel 29 (FIG. 3) in which the driver punch 25 is received for vertical movement. The cutting punch 26 is prevented from moving in any directions other than vertical by the inner walls of the tubular frame portion 15. By this arrangement, lateral movement of the driver punch 25 is also prevented. The cutting punch 26 also includes a step 26' which engages the upper surface of the head portion 25' of the driver punch to prevent further downward movement of the cutting punch 26. Beneath the driver punch 25, a bender 27 for bending a stop wire is mounted on the frame portion 15 for movement between a position in which it extends into the path of the movement of the driver punch 25 and a position in which it is out of the path of the driver punch movement. An anvil 28 is formed at the front end of the bender 27. As will be explained later, the anvil functions as a die which deforms the stop wire 31 into a bottom-opened rectangular configuration in cooperation with the cutting punch 26.

Figure 2:
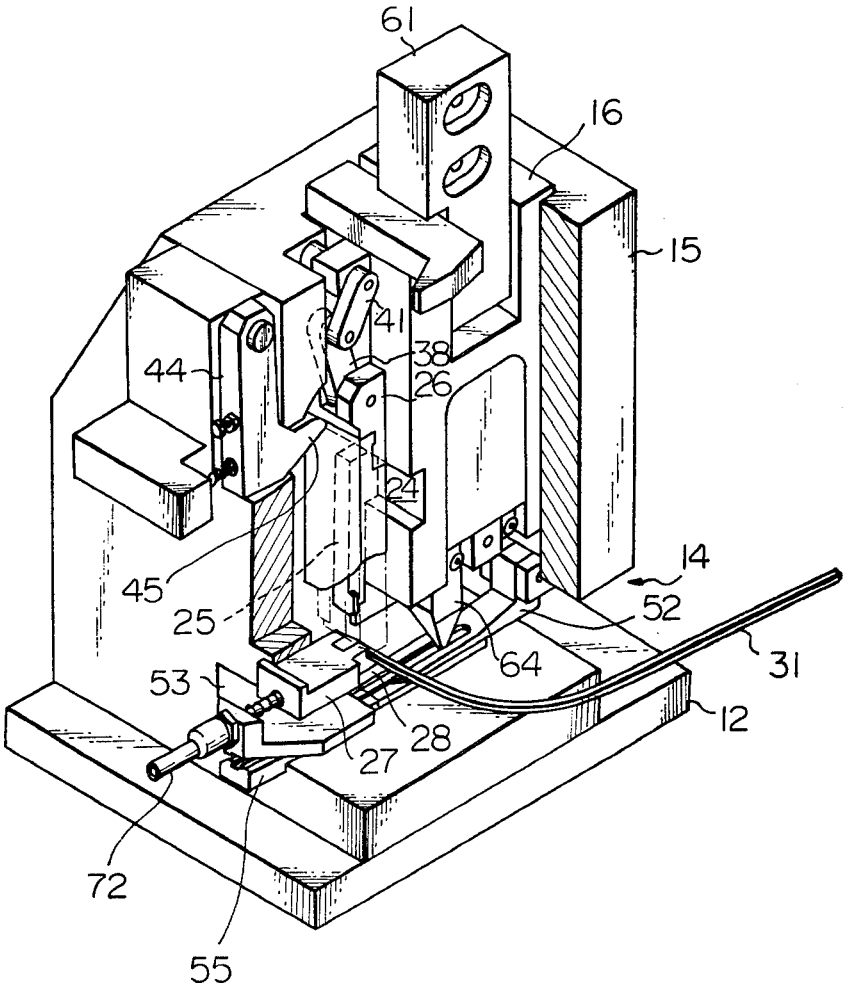
FIG. 2 is a perspective view of the apparatus of FIG. 1 with a portion thereof broken away.
Figure 3:
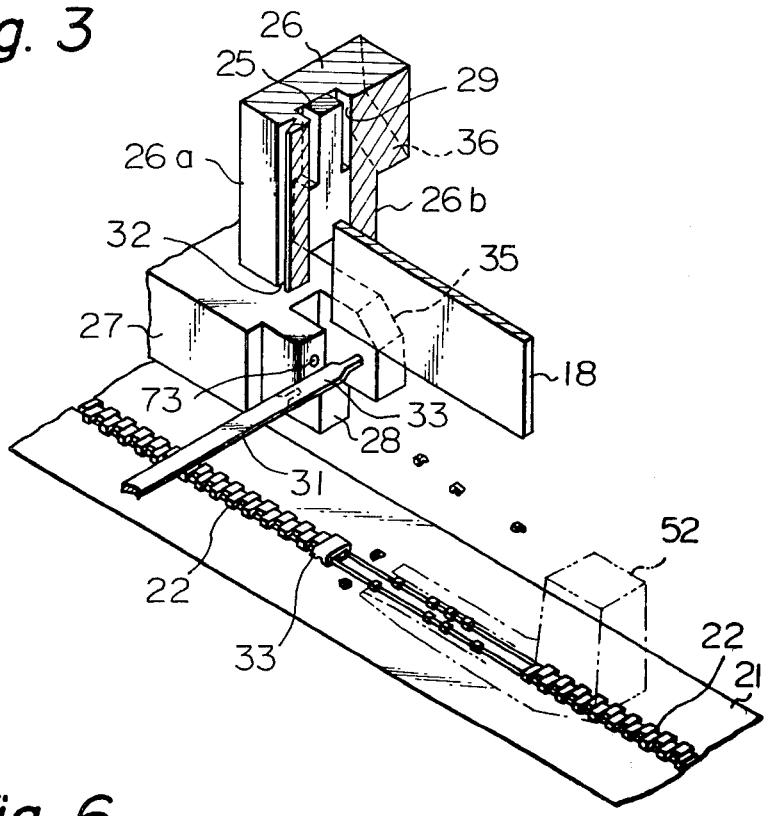
FIG. 3 is a perspective view showing relation between various punches.

The lower portion of the cutting punch 26 is bifurcated as shown in FIG. 2 so that the lower portion of the punch can move down beyond the upper surface of the bender 27 without interfering with it. As shown in FIG. 3, upstream one (26*a*) of the legs at the lower end portion of the cutting punch 26 with respect to the feeding direction of the stop wire 31 is provided with a generally triangular edge 32 along the outer margin thereof so that the stop wire 31 fed onto the anvil 28 is cut when the cutting punch 26 descends to form a stop blank 33 of a predetermined length having pointed opposite ends. During this cutting operation, a structure 34 for guiding the stop wire 31 functions as a die. As the cutting punch 26 further descends after cutting of the stop wire 31, the two legs 26*a* and 26*b* bend the opposite end portions of the stop blank 31 about the anvil 28 and form the stop blank into a bottom-opened rectangular configuration which is defined by the upper surface of the anvil and the inner sides of the legs. Cam surfaces 35 and 36 are formed on the bender 27 and the cutting punch 26, respectively, so that when the cutting punch 26 further descends after formation of the stop the cam surfaces contact each other to retract the bender against the force of a spring 39 to a position in which the anvil is out of the path of the movement of the driver punch 25. Thus, the stop is finally supported only by the legs of the cutting punch 26.

The cutting punch 26 is connected by releasable lost motion means to the punch holder 16 so that the cutting punch descends together with the punch holder to a preselected point, but does not follow further downward movement of the punch holder. For making this operation possible, the upper end of the cutting punch 26 is connected to a bracket 42 projecting from the punch holder 16 through two links 38 and 41 pivotally connected to each other by pin 37. Particularly, the upper end of the cutting punch 26 is pivotally connected to the lower end of the link 38 by a pin 37*a* and the upper end of the link 41 is pivotally connected to the bracket 42 by a pin 37*b*. The distance between the pins 37*a* and 37*b* is so selected that the combination of the links 38 and 41 outwardly expands. In other words, the lowermost position of the pin 37*a* is determined by engagement between the step 26' of the cutting punch 26 and the head portion 25' of the driver punch 25 and the position of the pin 37*a* determines the distance between the pins 37*a* and 37*b*. Guide surface 43 is provided in the tubular frame portion 15 to prevent outward expansion of the combination of the links 38 and 41 so that the downward movement of the punch holder 16 in the range in which this surface works is directly transmitted to the cutting punch 26. L-shaped lever 44 is swingably mounted on the frame portion 15 and biased by a spring 46 toward the position in which the lower end portion 45 is beneath the guide surface 43. As the punch holder 16 continues its downward movement, the combination of the links 38 and 41 comes out of engagement with the guide surface 43 and outwardly expands against the force of the spring 46 permitting only the punch holder 16 to descend. The timing is so selected that the links 38 and 41 come out of the guide surface just before the lower end of the cutting punch 26 reaches the tapes of the chain 21 so as not to damage the tapes. In this condition, the cutting punch exerts downwardly directed force due to the function of the spring 46. Therefore, the stop fixing operation can be done while the tapes are downwardly held. Although the pins 37, 37*a* and 37*b* are prevented from axially moving by the inner walls of the frame portion 15, they can be easily removed from the links 38 and 41 if the punch holder 16 is taken away from the frame portion 15 thereby permitting the two punches 25 and 26 to be easily disassembled from the punch holder 16.

A bending die portion 51 is formed on the casing 11 below the driver punch 25 to inwardly bend the legs of the stop 33 as they penetrate the tapes of the chain 21 due to depressing operation of the driver punch 25. The chain passage includes upper chain guides 52 and 53 and lower chain guides 54 and 55 in the inlet and outlet portions to guide the chain. The upper guide 52 is pivotally mounted on the frame portion 15 by pin 56 and is always biased to a position for compressing the chain by a spring 57.

The punch holder 16 is connected to a ram 58 of a press machine through a connecting rod 61. The connecting rod is connected to the punch holder 16 by a pin 62. This pin 62 is also easily removable, as are the pins 37, 37*a* and 37*b*, from the punch holder 16 by raising the punch holder 16 so that the upper portion thereof extends from the tubular frame portion 15 thereby permitting disconnection between the punch holder and the connecting rod 61.

A vertical hole 63 is formed in the punch holder 16. A registration member 64 is received in the hole for movement relative to the hole. Cross pins 65 and 66 are fixed in the hole 63 and extend in slots 67 and 68 in the registration member 64 which is downwardly biased by a spring. Therefore, the cross pins regulate the movement of the registration member. The configurations of the slots 67 and 68 are so selected that the lower end of the registration member 64 swings rightward as seen in FIG. 1 as the registration member moves upward relative to the punch holder 16. The lower end of the registration member 64 constitutes claw portions 71 which enter the small spaces between elements of the chain.

In FIGS. 1 and 2, numeral 72 designates an air duct which discharges pressurized air through a nozzle 73 in the bender 27 to blow off the waste resulting from shearing of the elements by the space punch 18 so as to avoid misshaping of the stop which would otherwise occur when a piece of the waste leaps onto the stop wire 31.

Figure 4:
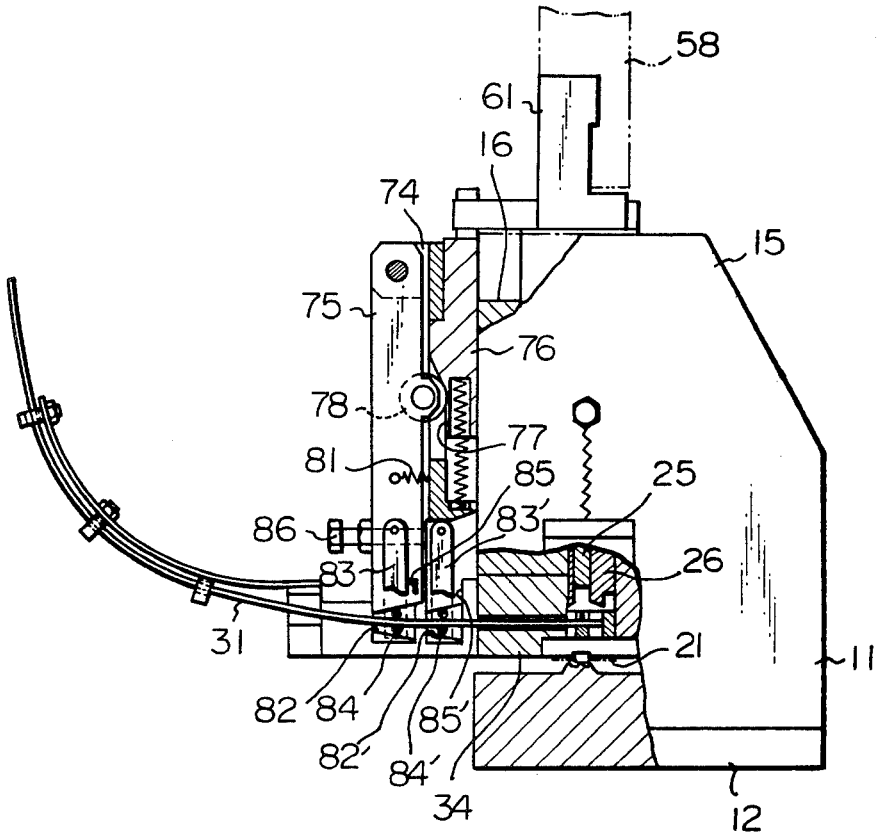
FIG. 4 is a side elevational view of the apparatus of FIG. 1 showing a mechanism for feeding a stop wire.

A feeding mechanism for stop wire 31 is shown in FIG. 4 to include a swing lever 75 pivotally mounted on a bracket 74 projecting from the frame portion 15. The punch holder 16 is provided with a cam member 76 secured thereto. The swing lever 75 is outwardly swung when the punch holder 16 reaches a predetermined point during its downward movement by cooperation between the cam surface 77 on the cam member 76 and the cam follower 78 mounted on the swing lever 75.

The swing lever 75 is biased rightwardly as seen in the drawing by a spring 81 so that it resumes the original position when the punch holder rises. A tapered channel 82 is formed in the lower portion of the swing lever 75 and a roll holder 83 is pivotally mounted on the side of the swing lever to which the tapered channel 82 opens. The roll holder 83 supports a pair of gripper rolls 84 so that the rolls transversely extend in the tapered channel 82 and can shift within certain range with respect to the roll holder. The roll holder 83 is biased rightwardly by a spring 85 and the rightward movement of the roll holder is prevented by a stopper (not shown) so that the roll holder takes the position shown in the drawing. Means identical with the tapered channel 82, roll holder 83, gripper rolls 84 and spring 85 are also provided on the casing 11. The respective means are indicated by the corresponding numerals with a prime.

When the punch holder 16 descends and the swing lever 75 swings outwardly accordingly, the gripper rolls 84 receive forces from the walls of the channel 82 and the wire 31 in the direction for shifting the gripper rolls to the base side of the tapered configuration. Therefore, the rolls 84 permit outward swing of the swing lever 75 without gripping the wire. During this operation, the rolls 84 apply weak frictional force to the wire 31 in leftward direction. However, since leftward movement of the wire tends to shift the gripper rolls 84' to the narrower side of the taper, the wire does not move gripped by the rolls 84'. When the punch holder 16 rises, the swing lever 75 swings in the opposite direction due to the function of the spring 81. During this operation, the wire 31 rightwardly moves with the swing lever by the effect of the gripper rolls 84 and 84' which operate oppositely to what is previously explained. The gripper rolls 84' permit this advancement of the wire. Thus, feeding of the wire 31 of the amount corresponding to the extent of the swing of the swing lever 75 is achieved. The amount of the wire feeding can be adjusted by changing the original position of the swing lever by means of an adjuster screw 86.

Figure 6:
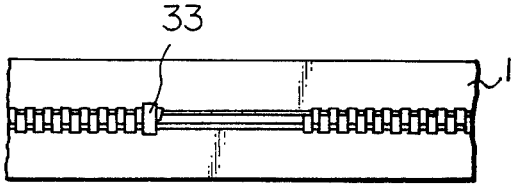
FIG. 6 is a plan view of a chain in which a space is formed and a stop is fixed.
Figure 5A:
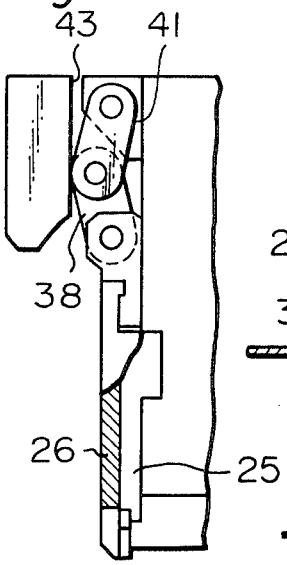
FIGS. 5A to 5D are schematic illustrations showing the operations of various punches.
Figure 5B:
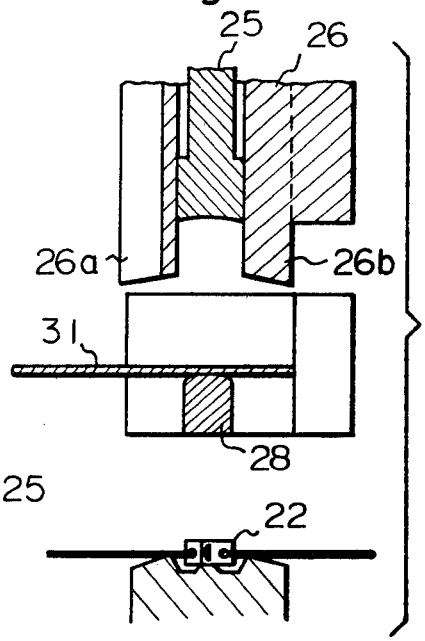
Figure 5C:
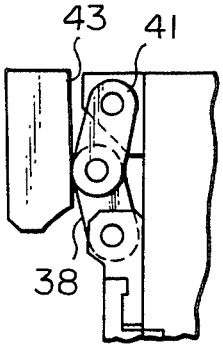
Figure 5D:
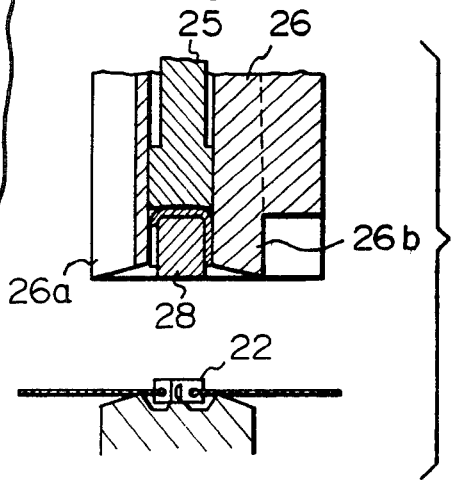
Figure 5E:
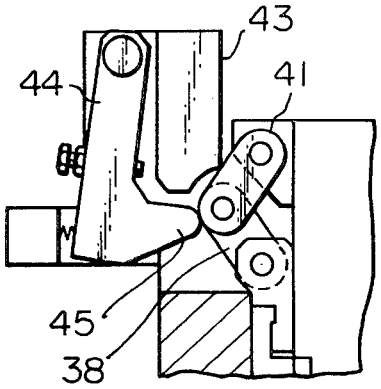
Figure 5F:
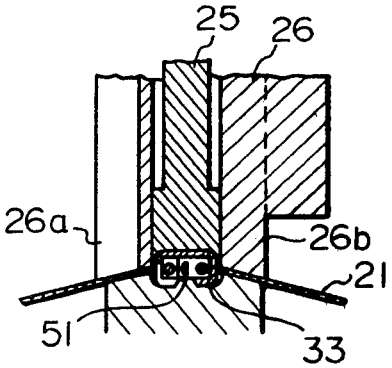
Figure 5G:
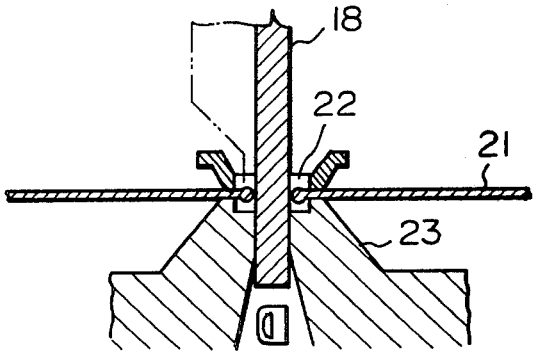

The operation of the apparatus of the invention will be explained. The chain 21 is incrementally advanced through the chain passage 14 by an unshown feeding mechanism. When the movement of the chain is stopped, the punch holder 16 descends and the claw portions 71 of the registration member 64 enter the spaces between the fastener elements of the chain. Further downward movement of the punch holder 16 makes the registration member rightwardly swing as explained before by a predetermined amount. By this operation, the chain 21 which is provisionally indexed by the feeding mechanism is further accurately registered. During this downward movement of the punch holder 16, the cutting punch 26 moves from the position of FIG. 5A to the position of FIG. 5B to cut the wire 31 which has been fed onto the anvil 28 to form it into a stop of a bottom-opened rectangular configuration. As the punch holder 16 further descends, the bender 27 retracts due to the cooperation of the cam surfaces 35 and 36 (FIG. 3) making the formed stop supported solely by the cutting punch 26. During further downward movement of the punch holder 16, engagement between a shoulder 47 of the cutting punch 26 and a shoulder 48 of the frame portion 15 prevents the cutting punch from moving down beyond the position in which the lower end of the cutting punch presses the tapes of the chain 21 with a weak force or a position just above the first said position. On the other hand, the driver punch 25 and the space punch 18 continue to descend with the punch holder 16 so that the space punch 18 shears off the heads of the fastener elements and the driver punch 25 drives the stop into the tapes while the inner walls of the leg portions **26*a* and 26*b* of the cutting punch 26 guide the stop to make the bending die portion 51 bend the legs of the stop to fix the stop on the tapes as shown in FIGS. 5C and 5D. Since the legs of the elements from which the heads are cut lose their ability to clamp the beaded edges of the tapes, they fall therefrom as shown in FIG. 3 to form an element free space (FIG. 6). During this operation, the waste of the cut elements are blown off by the air from the nozzle 73. Therefore, the waste does not interfere with the operation of the punches in the next cycle. Then the punch holder 16 is raised while the combination of the links 38 and 41 extends due to engagement with the cam surface 43 to make the cutting punch 26 resume the original relative position with respect to the other punches. Then the chain 21** is advanced by a predetermined amount and the identical cycle is repeated.

Figure 7:
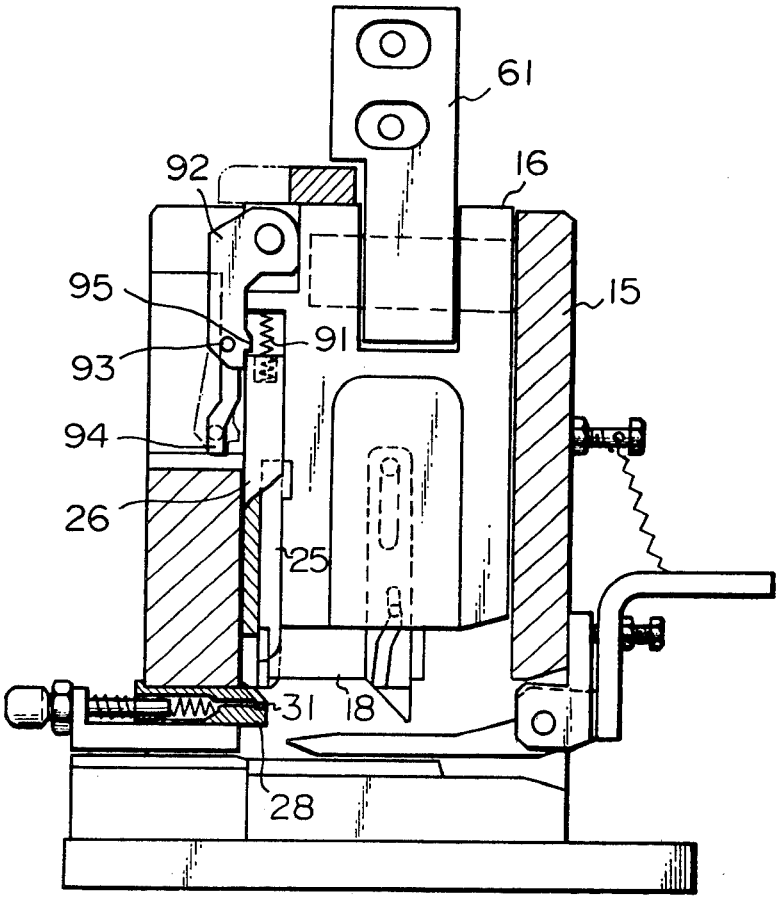
FIG. 7 is a longitudinal sectional view of another embodiment of this invention.

With respect to the embodiment explained above, the combination of the two links 38 and 41 pivotally connected to each other by the pin 37 is shown as an example of a last motion mechanism for connecting the cutting punch 26 to the punch holder 16. However, this invention is not limited to use of such mechanism. What is required is that the cutting punch descend with the punch holder 16 within a certain range of its downward movement and thereafter become upwardly movable relative to the punch holder whereby the cutting punch does not damage the tapes of the chain even when the space punch 18 and the driver punch 25 further descend for cutting of the elements and driving of the stop. FIG. 7 shows a modification of the mechanism for achieving such operations, wherein components identical with those in FIG. 1 are designated by the same numerals. The cutting punch 26 is connected to the punch holder 16 by a spring 91 which is nearly in its free condition so that the cutting punch stays in the illustrated position. A latch 92 is pivotally mounted on the punch holder and biased in counter-clockwise direction by an unshown spring. The swingable movement of the latch is regulated by a pin 93 mounted on the lower end thereof and received in a guide groove 94. The latch 92 is also provided with a shoulder 95 at the lower end thereof so that the shoulder can engage the upper end of the cutting punch 26. When the punch holder 16 descends, the cutting punch 26 also descends accordingly. When the cutting punch contacts the stop wire 31, it receives upwardly directed force from the wire. However, since the engagement between the shoulder 95 of the latch 92 and the upper end of the cutting punch 26 prevents the cutting punch from moving upwardly relative to the punch holder 16, the cutting punch moves down together with the punch holder. The configuration of the guide groove 94 is so selected that just before the lower end of the cutting punch 26 contacts the tapes of the chain 21, the latch 92 swings leftward (as shown by the phantom lines in FIG. 7) and the shoulder 95 disengages the cutting punch 26. Thus, even if the lower end of the cutting punch contacts the tapes, the cutting punch is kept in this position without pressing the tapes with a strong force. Compression of the spring 91 permits further downward movement of the punch holder 16. When the punch holder rises, the latch is guided by the groove 94 to rightwardly swing thereby resuming the position in which the shoulder 95 thereof can engage the upper end of the cutting punch 26. An unshown stopper may be provided between the frame portion 15 and the cutting punch 16 so that the cutting punch surely stops just before it contacts the tapes of the chain and stays there.

What is claimed is:

1. An apparatus for forming a space in and simultaneously fixing a stop to a fastener chain consisting of interengaged continuous stringers in which a space punch and a driver punch are provided for common movement, characterized in that the apparatus comprises:

a casing having a tubular frame portion;

a punch holder slidably received in said tubular frame portion and having said space and driver punches drivingly connected to the punch holder;

drive means for reciprocating said punch holder in said tubular frame portion;

a cutting punch provided between said driver punch and an inner wall of said tubular frame portion;

a bender mounted on said casing for movement between a position in which it projects into the path of the driver punch movement and a retracted position in which it is out of the path of the driver punch movement; and a wire feeder for feeding a stop forming wire onto said bender, said cutting punch having an edge at a lower end thereof to cut said wire by a predetermined length, the lower end of said cutting punch being bifurcated to form a stop of a bottom-side-opened rectangular shape in cooperation with the bender, said cutting punch further having a channel for slidably guiding said driver punch so that the driver punch moves relative to the cutting punch to press down on said stop, said cutting punch connected to said punch holder for reciprocation therewith via a releasable lost motion means for substantially disconnecting said cutting punch from the reciprocable movement of said punch holder after said cutting punch has moved down to a preselected point such that further downward movement of said punch holder beyond said point drives only said space and driver punches.

2. An apparatus according to claim 1 further characterized in that said driver punch is prevented from vertical movement relative to said punch holder by having a lateral head portion fitted in a lateral groove formed on the punch holder and from lateral movement relative to the punch holder by engaging said channel of the cutting punch.

3. An apparatus according to claim 1 further characterized in that said lost motion means for connecting said cutting punch and said punch holder comprises link means including two link members pivotally connected to each other by a pin with the opposite ends of the link means being pivotally connected to the punch holder and the cutting punch by pins, respectively, and a cam surface for preventing said link means from collapsing within predetermined range of the downward movement of the punch holder.

4. An apparatus according to claim 1 further characterized in that said lost motion means for connecting said cutting punch and said punch holder comprises a latch pivotally connected to the punch holder by a pin and having a shoulder engageable with a portion of the cutting punch, means for biasing the latch to a position in which said shoulder engages said cutting punch, and means for swinging the latch so that said shoulder moves off the cutting punch when the punch holder reaches a predetermined point during its downward movement.

5. An apparatus according to claim 3 or 4 further characterized in that each said pin is removably disposed in place for dissassembly when said punch holder is removed from the tubular frame portion.

* * * * *